US006430377B1

(12) United States Patent
Tsutsumi

(10) Patent No.: US 6,430,377 B1
(45) Date of Patent: Aug. 6, 2002

(54) IMAGE FORMING APPARATUS AND METHOD WITH SHEET REMOVAL AFTER JAM DETECTION

(75) Inventor: Kazuyoshi Tsutsumi, Kawasaki (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/668,346

(22) Filed: Sep. 25, 2000

(51) Int. Cl.[7] ..... G03G 15/00
(52) U.S. Cl. ..... 399/19; 399/20
(58) Field of Search ..... 399/18, 19, 20; 271/279, 902

(56) References Cited

FOREIGN PATENT DOCUMENTS

| | | | |
|---|---|---|---|
| JP | 58-17460 | * | 2/1983 |
| JP | 58-37663 | * | 3/1983 |
| JP | 2-95670 | * | 4/1990 |
| JP | 9-301623 | | 11/1997 |

* cited by examiner

*Primary Examiner*—Joan Pendegrass
(74) *Attorney, Agent, or Firm*—Foley & Lardner

(57) ABSTRACT

When a jam process is completed and a copying operation is restarted, a main CPU determines whether the copying operation which is presently set relates to copying of plural copy sets. If it is determined that the copying of plural copy sets is to be performed, the main CPU conforms which original in an order of originals is in the process of copying. If it is confirmed which original is in the process of copying, copies of this original already delivered on sort bins are discharged onto a recycle tray. Then, the set copying operation is restarted from copying of this original.

12 Claims, 7 Drawing Sheets

IMAGE FORMING APPARATUS AND METHOD WITH SHEET REMOVAL AFTER JAM DETECTION

BACKGROUND OF THE INVENTION

The present invention relates to an image forming apparatus for forming an image, such as a digital copying machine, which is equipped with a sorter for automatically sorting a plurality of copy sets.

In a conventional digital copying machine having a sorter for automatically sorting a plurality of copy sets, when a plurality of copy sets are to be obtained by taking a plurality of copies of each of a plurality of originals, copy sheets corresponding to each of the originals are distributed to a plurality of bins of the sorter. Thereby, one copy set is obtained in each of the bins.

In a digital copying machine having such a sorter for sorting plural copy sets, where a paper jam (hereinafter referred to as "jam") of a copy sheet has occurred in the machine body during the operation of copying plural copy sets and the copying operation is to be restarted after eliminating the jam, the user needs to visually confirm the sorted copy sheets and determine to which copy sheet in the order of copy sheets the copying operation should be returned. Alternatively, all the copy sheets sorted during the operation for copying plural copy sets are discarded and the copying operation is restarted from the beginning.

However, in the sorting of copy sheets after elimination of jam, the user may be confused at confirming the number of copy sheets, by which the copying operation is to go back. Moreover, if all the copy sheets sorted during the operation for copying plural copy sets are discarded and the copying operation is restarted from the beginning, normally formed copy sheets, too, are discarded and many sheets are wasted.

BRIEF SUMMARY OF THE INVENTION

The object of the present invention is to provide an image forming apparatus and an image forming method capable of sorting copy sheets without causing confusion to the user or wasting copy sheets.

In order to achieve the above object, there is provided an image forming apparatus for forming images on paper sheets, which has a sorter for sorting paper sheets with images onto a plurality of bins, the apparatus comprising: an alarming/stopping section for indicating occurrence of a jam and stopping an image forming operation of the image forming apparatus when the jam is detected during the image forming operation; a first checking section for determining, when a process for dealing with the jam indicated by the alarming/stopping section is completed and a restart of the image forming operation is instructed, whether an operation for forming a plurality of copy sets by making a plurality of copies of each of a plurality of originals in a predetermined order is set; a second checking section for determining, when the first checking section has determined that the operation for forming a plurality of copy sets by making a plurality of copies of each of a plurality of originals is set, whether there is an original a preset number of copies of which have not been made; a first control section for removing, when the second checking section has determined that there is an original a preset number of copies of which have not been made, copy sheets which are obtained by copying the original and are sorted onto the plural bins; and a second control section for restarting, after the first control section has removed the copy sheets of the original, the image forming operation from copying of the original in the predetermined order of the plural originals.

According to the present invention, there is also provided an image forming method for forming images on paper sheets, using a sorter for sorting paper sheets with images onto a plurality of bins, the method comprising: a first step of indicating occurrence of a jam and stopping an image forming operation of the image forming apparatus when the jam is detected during the image forming operation; a second step of determining, when a process for dealing with the jam indicated in the first step is completed and a restart of the image forming operation is instructed, whether an operation for forming a plurality of copy sets by making a plurality of copies of each of a plurality of originals in a predetermined order is set; a third step of determining, when the first step has determined that the operation for forming a plurality of copy sets by making a plurality of copies of each of a plurality of originals is set, whether there is an original a preset number of copies of which have not been made; a fourth step of removing, when the third step has determined that there is an original a preset number of copies of which have not been made, copy sheets which are obtained by copying the original and are sorted onto the plural bins; and a fifth step of restarting, after the copy sheets of the original have been removed in the fourth step, the image forming operation from copying of the original in the predetermined order of the plural originals.

DETAILED DESCRIPTION OF THE INVENTION

An embodiment of the present invention will now be described with reference to the accompanying drawings.

Figure 1:
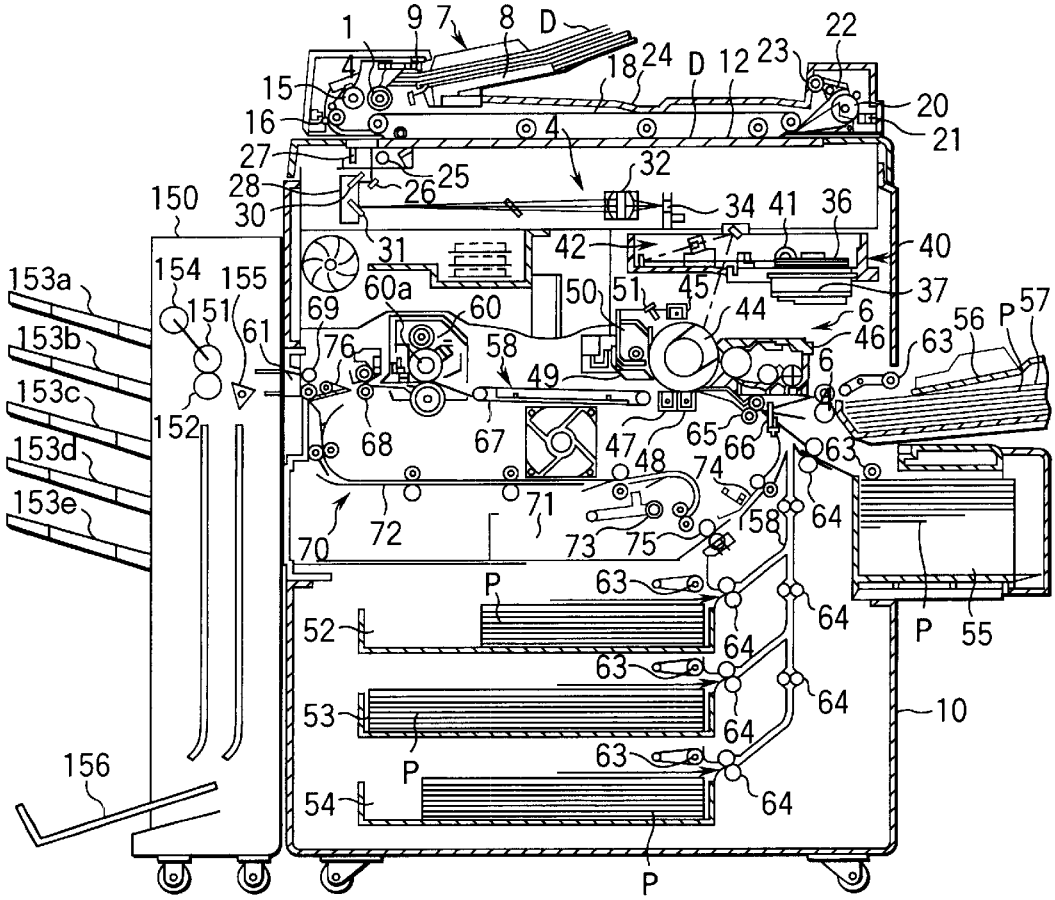
FIG. 1 shows an internal structure of a digital copying machine as an example of the image forming apparatus according to the present invention.

FIG. 1 shows an internal structure of a digital copying machine as an example of an image forming apparatus according to the present invention. This digital copying machine is, for example, a composite-type copying machine having three functions of a copying machine, a facsimile, and a printer.

In FIG. 1, reference numeral 10 denotes an apparatus main body. The apparatus main body 10 incorporates a scanner section 4 functioning as an image input means and a printer section 6 functioning as an image output means.

An original table 12 formed of transparent glass, on which a read object, i.e. an original D is placed, is disposed on the upper surface of the apparatus main body 10. An automatic document feeder 7 (hereinafter referred to as "ADF") for automatically feeding originals D onto the original table 12 is disposed on the upper surface of the apparatus main body 10. The ADF 7 is disposed to be opened/closed with respect to the original table 12 and serves as an original cover for bringing the original D placed on the original table 12 into close contact with the original table 12.

The ADF 7 has an original tray 8 on which the original D is set; an empty sensor 9 for detecting the presence/absence of originals D; pickup rollers 14 for picking up originals D on the original tray 8 one by one; a feed roller 15 for conveying the picked-up original D; an aligning roller pair 16 for aligning the leading edges of the originals D; and a conveyor belt 18 disposed to cover almost the entire surface of the original table 12. A plurality of originals D set on the original tray 8 with their surfaces facing up are sequentially taken out from the lowermost page, i.e. the last page, aligned by the aligning roller pair 16, and conveyed to a predetermined position on the original table 12 by the conveyor belt 18.

In the ADF 7, a reversing roller 20, a non-reverse sensor 21, a flapper 22 and a delivery roller 23 are disposed at the end portion on the opposite side of the aligning roller pair 16 with respect to the conveyor belt 18. The original D whose image information has been read by the scanner section 4 is fed from the original table 12 by the conveyor belt 18 and delivered to an original delivery section 24 on the ADF 7 through the reversing roller 20, flapper 21 and delivery roller 22. To read the lower surface of the original D, the flapper 22 is switched. The original D conveyed by the conveyor belt 18 is reversed by the reversing roller 20 and fed to a predetermined position on the original table 12 again by the conveyor belt 18.

The scanner section 4 provided in the apparatus main body 10 has an exposure lamp 25 as a light source for illuminating the original D placed on the original table 12, and a first mirror 26 for deflecting reflection light from the original D in a predetermined direction. The exposure lamp 25 and first mirror 26 are attached to a first carriage 27 disposed under the original table 12. The first carriage 27 is disposed to be movable in parallel to the original table 12 and reciprocally moved under the original table 12 by a driving motor through a toothed belt (not show), etc.

A second carriage 28 movable in parallel to the original table 12 is disposed under the original table 12. Second and third mirrors 30 and 31 for successively deflecting reflection light from the original D, which has been deflected by the first mirror 26, are attached to the second carriage 28 at right angels with each other. The second carriage 28 is moved by, e.g. the toothed belt for driving the first carriage 27 along with the first carriage 27, and moved in parallel along the original table 12 at half the speed of the first carriage.

A focusing lens 32 for focusing reflection light from the third mirror 31 mounted on the second carriage 28, and a CCD line sensor 34 serving as photoelectric conversion means for receiving the reflected light focused by the focusing lens 32 and photoelectrically converting it are also disposed under the original table 12. The focusing lens 32 is disposed in a plane including the optical axis of the light deflected by the third mirror 31 so as to be movable by means of a driving mechanism. The focusing lens 32 moves to focus the reflection light at a desired magnification. The line sensor 34 photoelectrically converts the incoming reflection light and outputs an electrical signal corresponding to the read original D.

On the other hand, the printer section 6 has a laser exposure unit 40 functioning as a latent image forming means. The laser exposure unit 40 comprises a semiconductor laser 41 as a light source; a polygon mirror 36 as a scanning member for continuously deflecting a laser beam emitted by the semiconductor laser 41; a polygon motor 37 as a scanning motor for rotatably driving the polygon mirror 36 at a predetermined rotational speed (to be described later); and an optical system 42 for deflecting the laser beam from the polygon mirror 36 and guiding the beam to photosensitive drum 44 (to be described later). The laser exposure unit 40 with the above structure is fixed to a support frame (not shown) of the apparatus main body 10.

The semiconductor laser 41 is ON/OFF-controlled in accordance with the image information of the original D read by the scanner section 4 or facsimile transmission/reception document information. The laser beam is directed to the photosensitive drum 44 through the polygon mirror 36 and optical system 42 to scan the outer surface of the photosensitive drum 44, thereby forming an electrostatic latent image on the outer peripheral surface of the photosensitive drum 44.

The printer section 6 has the rotatable photosensitive drum 44 as an image carrier disposed almost at the center of the apparatus main body 10. The outer peripheral surface of the photosensitive drum 44 is exposed to the laser beam from the laser exposure unit 40, and so a desired electrostatic latent image is formed thereon. Around the photosensitive drum 44, the following elements are arranged in the named order: a charger 45 for electrifying the outer peripheral surface of the drum 44 with a predetermined charge; a developing device 46 serving as developing means for supplying toner as a developer to the electrostatic latent image formed on the outer peripheral surface of the photosensitive drum 44 to develop it at a desired image density; a separation charger 47 for separating an image formation medium, i.e. a paper sheet P, fed from a paper cassette (to be described later) from the photosensitive drum 44; a transfer charger 48 for transferring the toner image formed on the photosensitive drum 44 onto the paper sheet P; a separation gripper 49 for separating the paper sheet P from the outer peripheral surface of the photosensitive drum 44; a cleaning unit 50 for removing toner remaining on the outer peripheral surface of the photosensitive drum 44; and a discharger 51 for de-electrifying the outer peripheral surface of the photosensitive drum 44.

An upper sheet cassette 52, a middle sheet cassette 53 and a lower sheet cassette 54 which can be drawn out of the apparatus main body 10 are stacked at the lower portion of the apparatus main body 10. These cassettes 52 to 54 store paper sheets P of different sizes. A large-capacity feeder 55 is disposed on one side of these cassettes. This large-capacity feeder 55 stores about 3,000 paper sheets P having a size with high use frequency, e.g. paper sheets P with A4 size. A feed cassette 57 also serving as a manual feed tray 56 is detachably attached above the large-capacity feeder 55.

A convey path 58 extending from the sheet cassettes 52 to 54 and large-capacity feeder 55 through a transfer section located between the photosensitive drum 44 and transfer charger 48 is formed in the apparatus main body 10. A fixing unit 60 having a fixing lamp **60*a* is disposed at the end of the convey path 58. A delivery port 61 is formed in the side wall of the apparatus main body 10, which is opposed to the fixing unit 60. A sorter 150 is attached to the delivery port 61**.

Pickup rollers 63 for taking out the paper sheets P one by one from the sheet cassette, 52, 53, 54, 57 or large-capacity feeder 55 are arranged near each of the upper sheet cassette 52, middle sheet cassette 53, lower sheet cassette 54 and feed cassette 57 and near the large-capacity feeder 55. A number of feed roller pairs 64 for conveying the paper sheet P taken out by the pickup rollers 63 through the convey path 58 are arranged in the convey path 58.

A registration roller pair 65 is arranged in the convey path 58 on the upstream side of the photosensitive drum 44. The registration roller pair 65 corrects a tilt of the extracted paper sheet P, registers the leading edge of the toner image on the photosensitive drum 44 and the leading edge of the paper sheet P, and feeds the paper sheet P to the transfer section at the same speed as the speed of movement of the outer peripheral surface of the photosensitive drum 44. A pre-aligning sensor 66 for detecting arrival of the paper sheet P is provided in front of the registration roller pair 65, i.e. on the feed roller 64 side.

Each paper sheet P extracted one by one from the sheet cassette, 52, 53, 54, 57 or large-capacity feeder 55 by the pickup rollers 63 is fed to the registration roller pair 65 by the feed roller pair 64. After the leading edge of the paper sheet P is aligned by the registration roller pair 65, the paper sheet P is fed to the transfer section.

In the transfer section, a developer image, i.e. toner image formed on the photosensitive drum 44 is transferred onto the paper sheet P by the transfer charger 48. The paper sheet P on which the toner image has been transferred is separated from the outer peripheral surface of the photosensitive drum 44 by the function of the separation charger 47 and separation gripper 49 and conveyed to the fixing unit 60 through a conveyor belt 67 constituting part of the convey path 52. After the developer image is melted and fixed on the paper sheet P by the fixing unit 60, the paper sheet P is delivered onto the sorter 150 through the delivery port 61 by a feed roller pair 68 and a delivery roller pair 69.

An automatic double-side unit 70 for reversing the paper sheet P which has passed through the fixing unit 60 and feeding it to the registration roller pair 65 again is provided under the convey path 58. The automatic double-side unit 70 comprises a temporary stack 71 for temporarily stacking the paper sheets P; a reversing path 72 branched from the convey path 58 to reverse the paper sheet P which has passed through the fixing unit 60 and to guide the paper sheet P to the temporary stack 71; pickup rollers 73 for extracting the paper sheets P stacked on the temporary stack 71 one by one; and a feed roller 75 for feeding the extracted paper sheet P to the registration roller pair 65 through a convey path 74. A selector gate 76 for selectively distributing the paper sheets P to the delivery port 61 or reversing path 72 is provided at the branch portion between the convey path 58 and reversing path 72.

Where double-copying is performed, the paper sheet P which has passed through the fixing unit 60 is guided to the reversing path 72 by the selector gate 76, temporarily stacked on the temporary stack 71 in a reversed state, and fed to the registration roller pair 65 through the convey path 74 by the pickup rollers 73 and feed roller 75. The paper sheet P is registered by the registration roller pair 65 and fed to the transfer section again to transfer a toner image onto the reverse surface of the paper sheet P. Thereafter, the paper sheet P is delivered to the sorter 150 through the convey path 58, fixing unit 60 and delivery rollers 69.

An operation panel 80 (not shown) for inputting various copy conditions and a copy start command for starting copying operation and displaying the operation state, etc. is provided at the upper portion on the front side of the apparatus main body 10.

The sorter 150 feeds the paper sheets P discharged from the delivery port 61 to sort bins 153*a* to 153*e* using a feed roller 151 and a separation roller 152. The sorter 150 is provided with a pickup roller 154, a gate 155, and a recycle tray 156, as will be described later.

Figure 2:
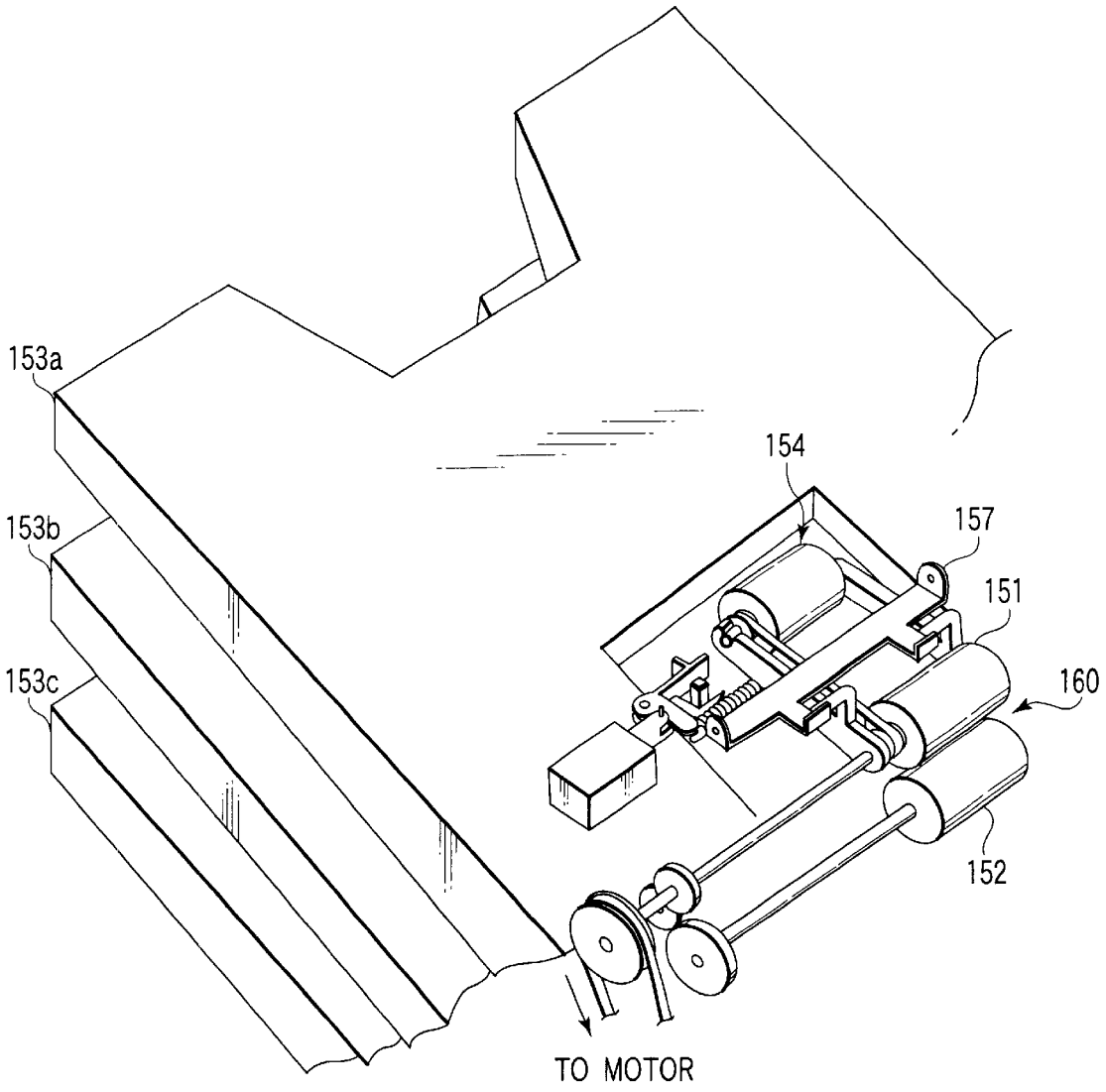
FIG. 2 shows a structure of a separation roller section comprising a feed roller and a separation roller.

FIG. 2 shows a structure of a separation roller section 160 comprising the feed roller 151 and separation roller 152. A pickup bracket 157 is provided between the feed roller 151 and pickup roller 154. The feed roller 151 is rotated by a motor (not shown).

Figure 3:
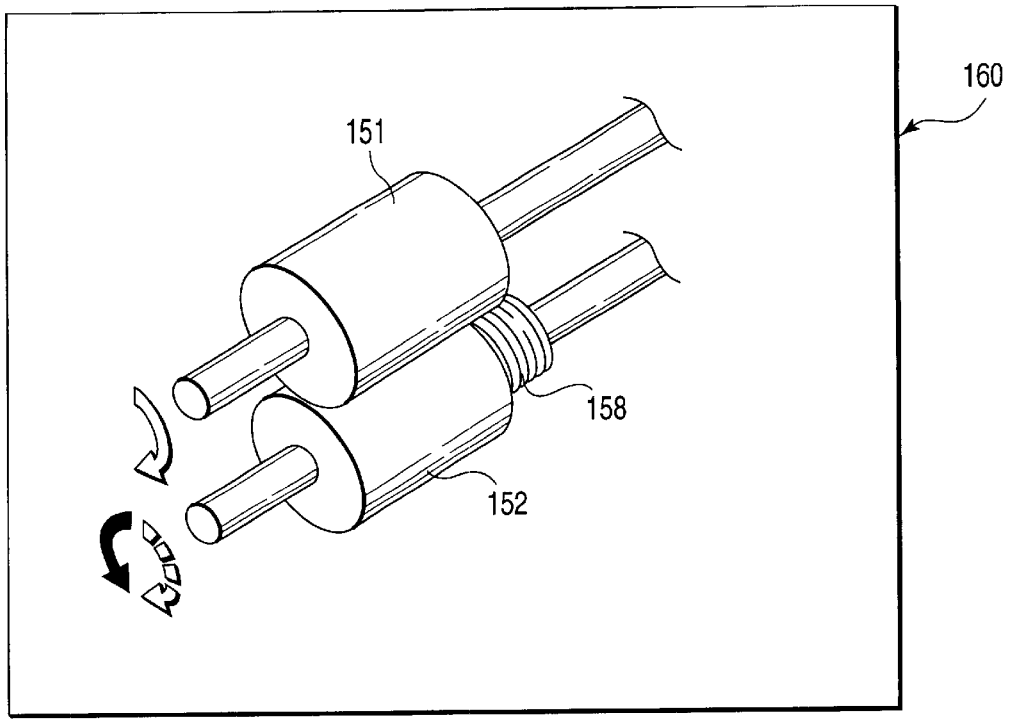
FIG. 3 illustrates an operation for separating a paper sheet by means of the separation roller section.
Figure 4:
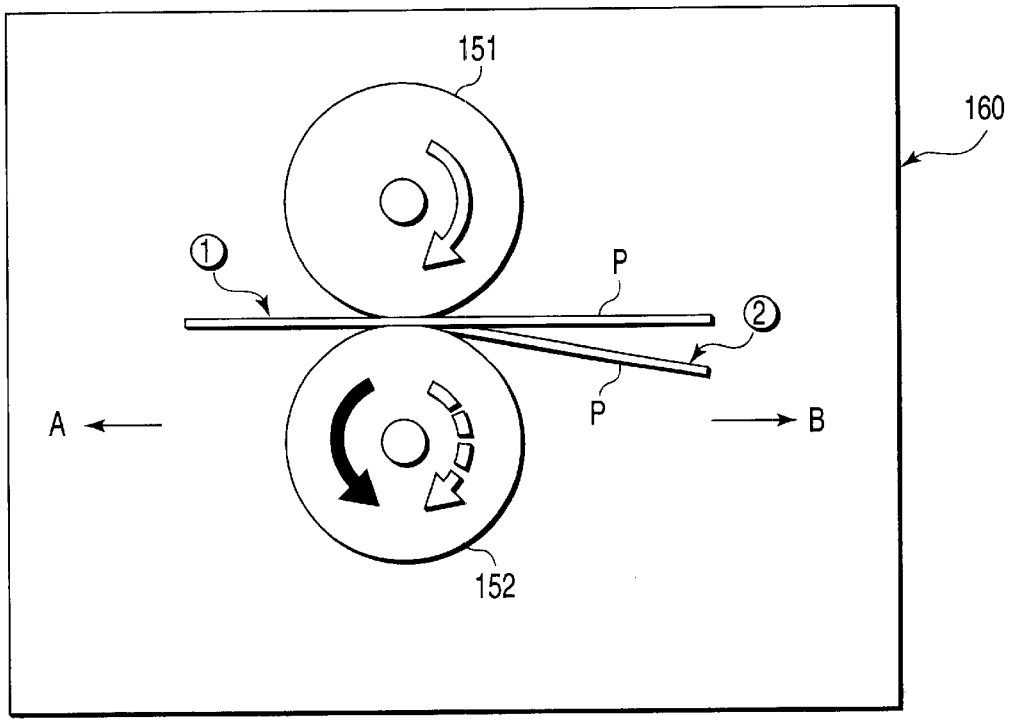
FIG. 4 illustrates the operation for separating a paper sheet by means of the separation roller section.

FIGS. 3 and 4 illustrate an operation for separating the paper sheet P by means of the separation roller section 160. Specifically, as shown in FIG. 3, the separation roller section 160 comprises the feed roller 151, the separation roller 152, a spring joint (torque limiter) 158 provided on the separation roller 152, etc. The feed roller 151 is rotated by a motor (not shown) in a direction of a white-line arrow in synchronism with the pickup roller 154.

On the other hand, the separation roller 152 is urged to rotate in a direction of a white-line arrow. In the state in which the paper sheet P is not present or one paper sheet P is being fed, a great friction acts between the rollers or between the sheet and the separation roller 152. Accordingly, the separation roller rotates in a direction of a black-line arrow and the spring joint 158 slips.

However, when two paper sheets P are being fed, as shown in FIG. 4, a little friction acts between the paper sheets P, and the lower sheet P (①) is returned by the separation roller 152 in a direction B while the upper sheet P (②) is fed by the feed roller 151 in a direction A. In this way, paper sheets P are exactly fed one by one. For example, if one paper sheet P (①) alone has entered the separation roller section 160, as shown in FIG. 4, the separation roller 152 rotates in a black-line direction and the paper sheet P is fed in the direction A since the conveyance force of the feed roller 151 is greater than that of the separation roller 152. If two paper sheets P (① and ②) have entered the separation roller section 160 at a time, the paper sheet P (①) is fed by the feed roller 151 in the direction A while the paper sheet (②) is returned by the separation roller 152 in the direction B.

Figure 5:
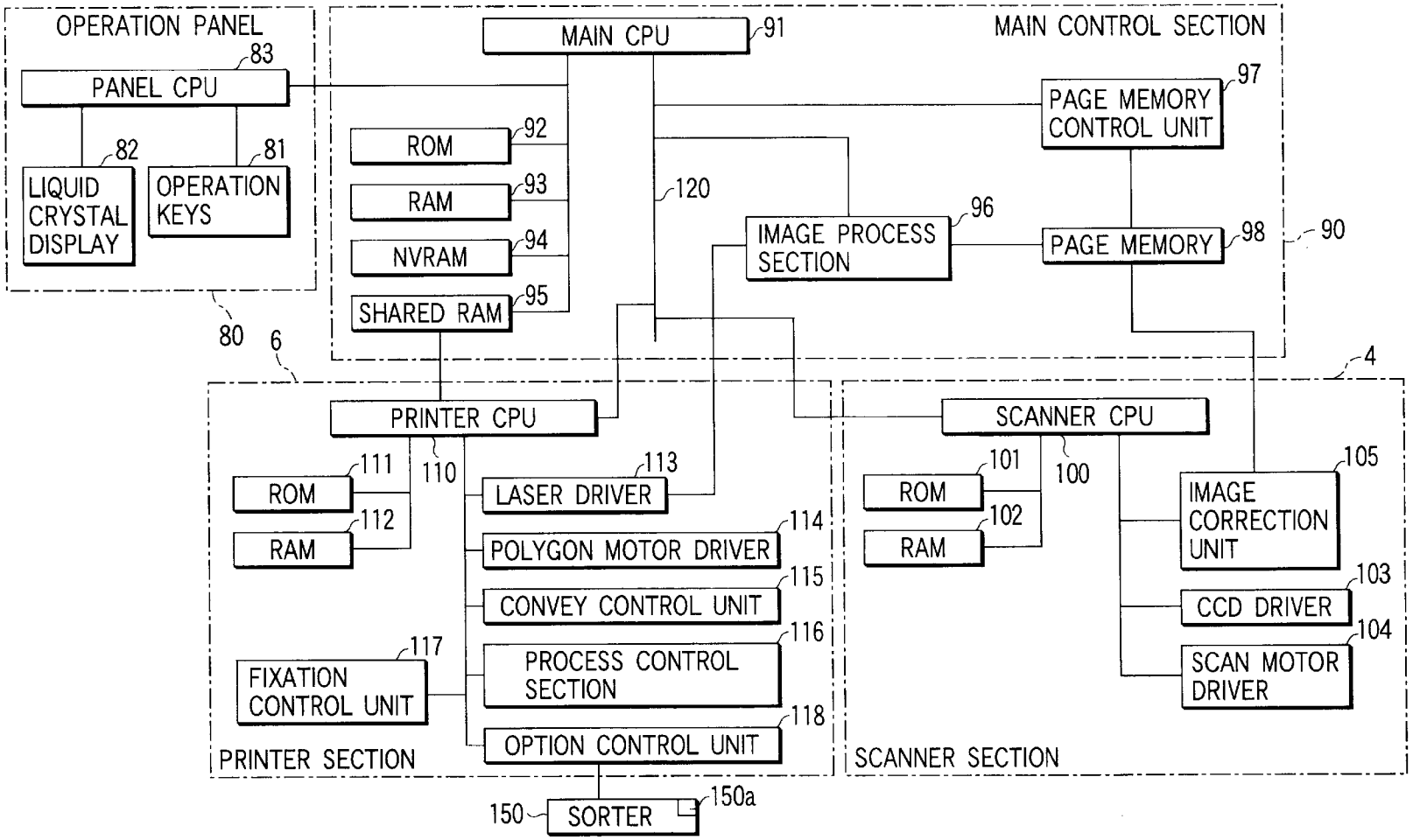
FIG. 5 is a block diagram schematically showing electrical connection of the digital copying machine shown in FIG. 1 and flow of signals for control.

FIG. 5 is a block diagram schematically showing electrical connection of the digital copying machine shown in FIG. 1 and flow of signals for control. In FIG. 5, a control system comprises three CPUs (Central Control Units): a main CPU 91 provided in a main control section 90; a scanner CPU 100 in the scanner section 4; and a printer CPU 110 in the printer section 6. These CPUs are connected by a shared bus 120.

The main CPU 91 performs bi-directional communication with the printer CPU 110 via a shared RAM 95. The main CPU 91 issues an operational instruction, and the printer CPU 110 returns status data. Serial communication is performed between the printer CPU 110 and scanner CPU 100. The printer CPU 110 issues an operational instruction, and the scanner CPU 100 returns status data.

The shared bus 120 is a complete sync bus, like a PCI bus. In the shared bus 120, a single signal line is shared by an address bus and a data bus in a time-division manner. A peripheral device for program I/O transfer via the CPUs serves as a bus master for controlling the shared bus. Data transfer by the bus master, in which a memory, etc. are directly accessed, is possible.

An operation panel 80 comprises various operation keys 81, a liquid crystal display 82, and a panel CPU 83 to which the LCD 82 and operation keys 81 are connected. The operation panel 80 is connected to the main CPU 91.

The main control section 90 comprises the main CPU 91, a ROM 92, a RAM 93, an NVRAM 94, shared RAM 95, an image process section 96, a page memory control unit 97, and a page memory 98.

The main CPU 91 controls the entirety of the main control section 90. The ROM 92 stores control programs, etc. for the main CPU 91. The RAM 93 temporarily stores various data.

The NVRAM (Non-Volatile RAM) 94 is a non-volatile memory backed up by a battery (not shown). Even when power is not supplied to the NVRAM 34, stored data is maintained.

The shared RAM 95 is used to perform bi-directional communication between the main CPU 91 and printer CPU 110.

The page memory control unit 97 stores and reads out image information in and from the page memory 98. The page memory 98 has areas capable of storing image information of a plurality of pages. The page memory 98 can store compressed data in units of a page, which is obtained by compressing image information from the scanner section 4.

The scanner section 4 comprises the scanner CPU 100 for controlling the entirety of the scanner section 4; a ROM 101 storing control programs, etc.; a data storage RAM 102; a CCD driver 103 for driving the line sensor 34; a scan motor driver 104 for controlling the rotation of a scan motor for moving the exposure lamp 25, mirrors 26, 27 and 28, etc.; and an image correction unit 105.

The image correction section 105 comprises an A/D converter for converting analog signals output from the line sensor 34 to digital signals; a shading correction circuit for correcting a variance in the line sensor 34, or a variation in threshold level due to ambient temperature variation relative to the output signal from the line sensor 34; and a line memory for temporarily storing shading-corrected digital signals from the shading correction circuit.

The printer section 6 comprises the printer CPU 110 for controlling the entirety of the printer section 6; a ROM 111 storing control programs, etc.; a data storage RAM 112; a laser driver 113 for driving the semiconductor laser 41; a polygon motor driver 114 for driving the polygon motor 37 of the laser exposure unit 40; a convey control unit 115 for controlling conveyance of the paper sheet P by the convey mechanism 58; a process control section 116 for controlling charging, developing and transferring processes using the charging device 45, developing device 46 and transfer charger 48; a fixation control unit 117 for controlling the fixing device 60; and an option control unit 118 for controlling the sorter 150 as an option.

Upon receiving a sense signal from a jam sensor 150*a* provided on the sorter 150, the option control unit 118 tells the occurrence of jam to the main CPU 91.

The image correction section 105, page memory 98, image process section 96 and laser driver 113 are serially connected, and image data flows through these elements in the named order. It is possible, however, to let image data flow from the image correction section 105 to the image process section 96, without storing it in the page memory 98.

Figure 6:
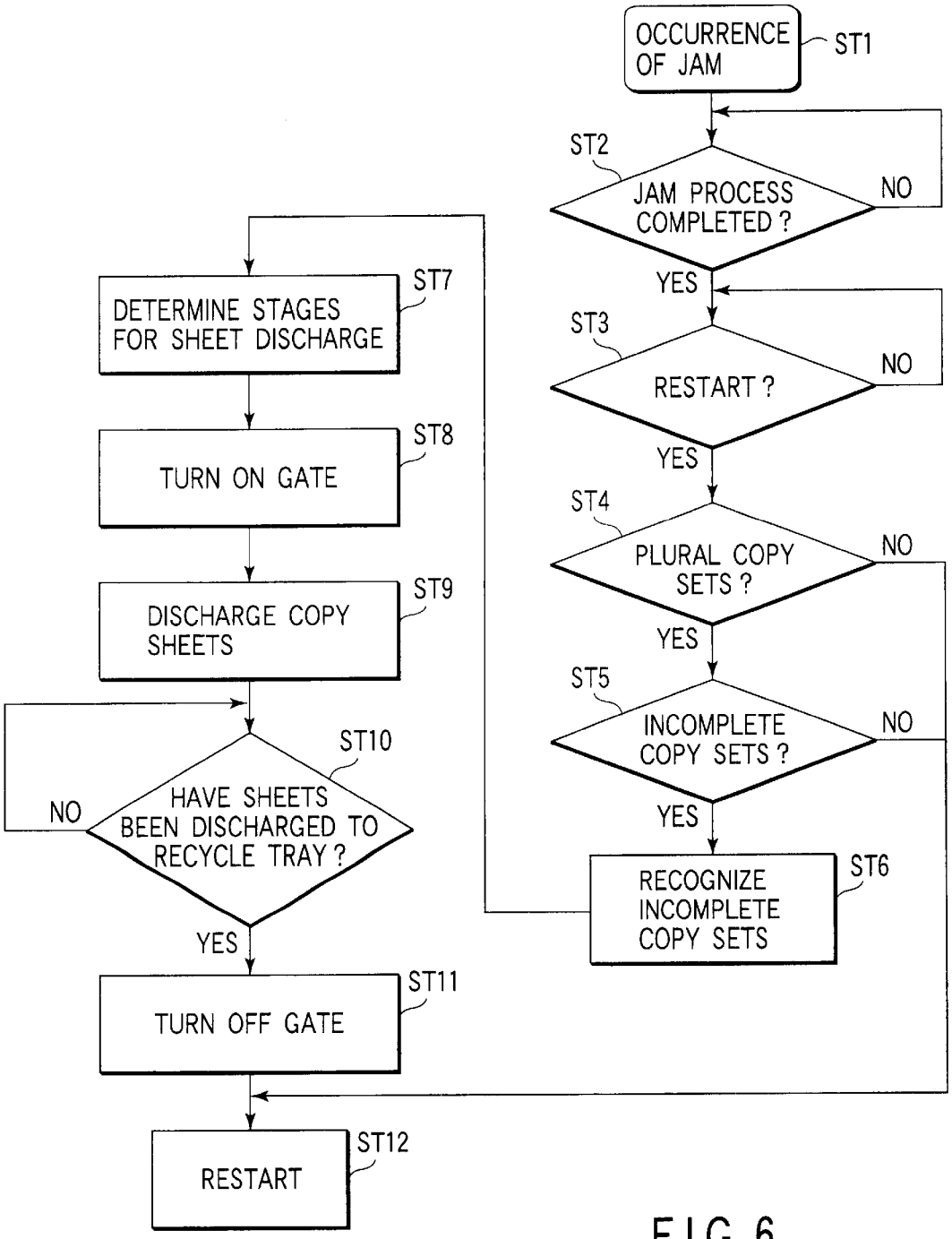
FIG. 6 is a flow chart illustrating an operation in a case where a jam has occurred in the digital copying machine.

An operation of the digital copying machine with the above structure in a case where a jam has occurred in the digital copying machine will now be described with reference to a flow chart of FIG. 6.

Assume that the user has set through the operation panel 80 an operation for forming a plurality of copy sets, e.g. 10 copy sets each comprising copies corresponding to 5 originals, and the copying operation has been executed. When a copy sheet in a third copy set, which corresponds to a third original, has been jammed in the sorter 150 in the copying operation, a sense signal is sent from the jam sensor 150*a* of sorter 150 to the option control section 118. The option control section 118 tells the occurrence of jam to the main CPU.

Figure 7:
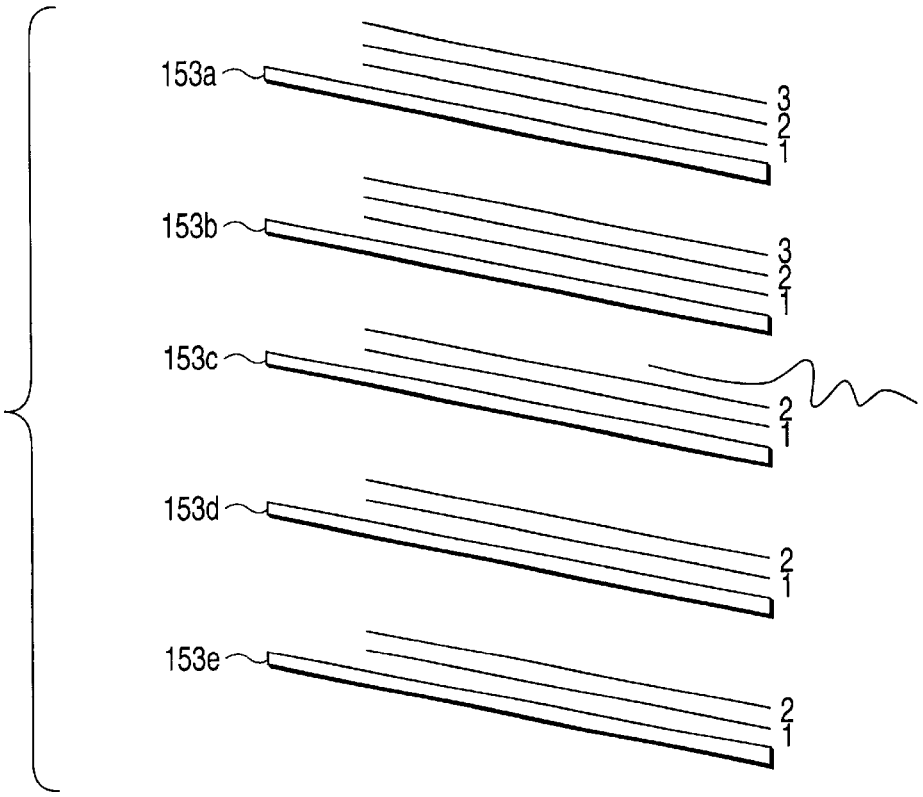
FIG. 7 shows a state in which a copy sheet in a third copy set, which copy sheet corresponds to a third original, has been jammed.

FIG. 7 shows this state. The copying sheet in the third copy set on the sort bin 153*c* has been jammed.

If the main CPU 91 is informed of the jam (ST1), it stops the operation of the machine, causes the liquid crystal display 82 of operation panel 80 to display the occurrence of jam, and waits for completion of a jam process (ST2).

The user removes the jammed sheet.

However, since the operation of the machine was stopped when the jam occurred, the user is unable to understand at what stage the copying operation was stopped and from what stage the copying operation is to be restarted. The user may understand it by viewing the sorter and recognizing the number of copy sets for restarting the copying operation on the basis of the copy sheets delivered on each sort bin. However, it cannot be understood the copy sheets delivered on the uppermost sorter bin is the result of the completion of copying operation for all copy sets, and the user may be confused. If the count number in the machine differs from the number cognized by the user at this time, erroneous copying will occur.

In order to avoid such erroneous copying and exactly carry out the copying operation, it is necessary to discard all copy sheets delivered thus far and restart the copying operation from the beginning. In this case, normal copies, too, are all wasted.

To solve this problem, the apparatus of the present invention is provided with a mechanism for automatically removing copy sheets associated with incomplete copy sets, and only copy sheets associated with incomplete copy sets are removed.

After the jammed sheet is removed in step ST2, the user presses the operation key 81 to restart the copying operation.

After the jam process is finished and the operation is restarted (ST2 and ST3), the main CPU 91 determines whether the halted copying operation is in such a mode that plural copy sets are to be formed by making a plurality of copies of each of plural originals (ST4). If the copying operation is set in this mode, the main CPU 91 checks the copy output counted by the page memory control unit 97 which controls the page memory 98 and determines whether there is an incomplete copy set (i.e. the state in which the number of copies of an n-th original has not reached a preset value) (ST5).

If the presence of the incomplete copy set is determined in step ST5 (ST6), the main CPU 91 checks the copy output counted by the page memory control unit 97 which controls the page memory 98 and determines the number of stages for sheet discharge (ST7).

In this example, as shown in FIG. 7, a paper sheet of the third copy set, which paper sheet is associated with a third original, was jammed, and the user has removed it, as mentioned above. That is, the copy paper sheet in the third copy set stacked on the sort bin 153*c* was removed. Thus, the main CPU 91 determines the number of stages (i.e. sort bins) for discharge in order to automatically remove the copy sheets which are associated with the third original and have already been distributed onto the sort bins (ST7). In this case, the sort bins 153*a* and 153*b*, onto which the copy sheets associated with the third original have already been delivered, are determined.

The main CPU 91, then, turns on the gate 155 (ST8), thereby to guide the copy sheets to be discharged toward the recycle tray 156.

Thus, the main CPU 91 causes the copy sheets, which are associated with the third original and placed on the sort bins 153*a* and 153*b*, to be discharged onto the recycle tray 156, using the pickup roller 154, feed roller 151 and separation roller 152 (ST9).

Figure 8:
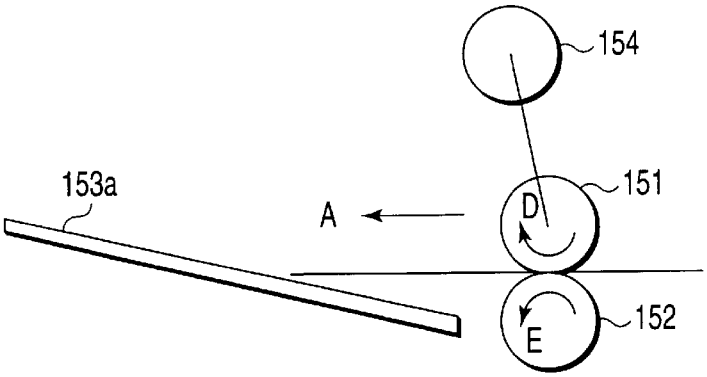
FIG. 8 illustrates an operation for delivering a copy sheet onto a sort bin.
Figure 9:
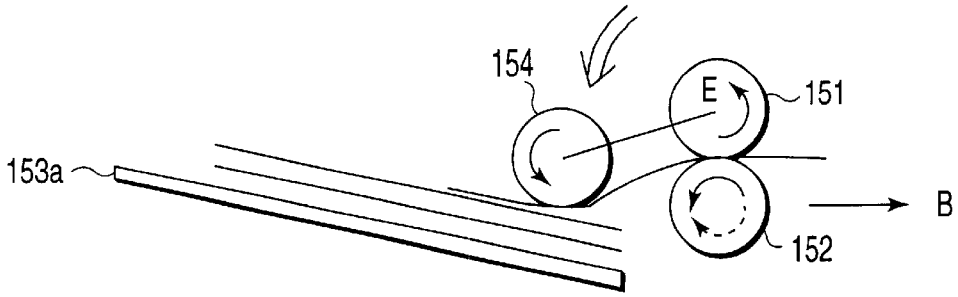
FIG. 9 illustrates an operation for removing a copy sheet on a sort bin.
Figure 10:
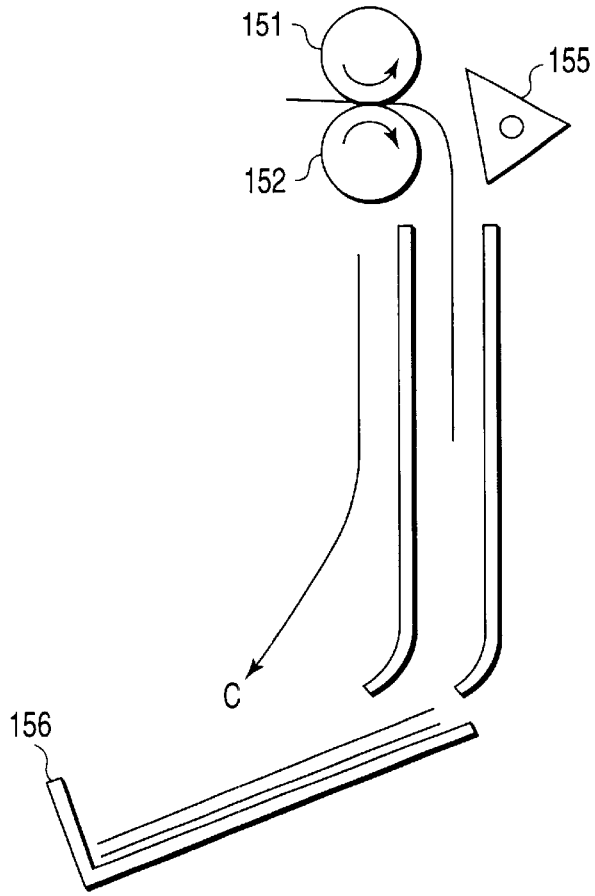
FIG. 10 illustrates an operation for removing a copy sheet on a short bin.

FIGS. 8, 9 and 10 illustrate the operation for discharging copy sheets on the sort bins.

FIG. 8 illustrates the operation for delivering the normal copy sheet onto the sort bin (153*a*). The feed roller 151 is rotated in the direction D and the separation roller 152 is rotated in the opposite direction E, whereby the copy sheet is fed in the direction A onto the sort bin (153*a*).

FIG. 9 illustrates the rotations of the respective rollers when the copy sheet on the sort bin is to be discharged. To begin with, the main CPU 91 causes the pickup roller 154 to be turned onto the copy sheet on the stage for sheet discharge, e.g. the sort bin 153*a*. The pickup roller 154 picks up the uppermost copy sheet in the direction B. In this case, as a matter of course, the feed roller 151 is rotated in the direction E, which is reverse to the direction D. As was described with reference to FIG. 4, the separation roller 152 is driven so as to discharge one sheet alone (i.e. separation function).

FIG. 10 illustrates the operation in which the copy sheet discharged by the feed roller 151 and separation roller 152 is conveyed onto the recycle tray 156. The copy sheet discharged by the feed roller 151 and separation roller 152 is guided in the direction C since the gate 155 is turned on (i.e. opened) and the copy sheet is conveyed onto the recycle tray 156.

The reverse side of the copy sheet discharged onto the recycle tray 156 is re-used.

When copy sheets are distributed by the sorter 150, the sort bins (153*a* to 153*e*) are vertically shifted. Thus, when the copy sheets on the plural sort bins are to be discharged, it should suffice if the sort bins (153*a* to 153*d*) are similarly vertically shifted and the copy sheets are picked up by the pickup roller 154.

After the copy sheets which are associated with the third original and placed on the sort bins 153*a* and 153*b* are discharged onto the recycle tray 156 (ST10), the gate 155 is turned off (ST11) and the copying operation is restarted from the copying of the third original (ST12).

As has been described above, according to the embodiment of the present invention, the sorter is provided with the mechanism for automatically removing copy sheets associated with incomplete copy sets. Thus, the location of the sort bin, from which the copying operation is to be restarted, can easily been understood even after paper jam is eliminated. Therefore, the user is not confused and waste of paper sheets is prevented cost-effectively.

What is claimed is:

1. An image forming apparatus for forming images on paper sheets, which has a sorter for sorting paper sheets with images onto a plurality of bins, the apparatus comprising:

an alarming/stopping section for indicating occurrence of a jam and stopping an image forming operation of the image forming apparatus when the jam is detected during the image forming operation;

a first checking section for determining, when a process for dealing with the jam indicated by the alarming/stopping section is completed and a restart of the image forming operation is instructed, whether an operation for forming a plurality of copy sets by making a plurality of copies of each of a plurality of originals in a predetermined order is set;

a second checking section for determining, when the first checking section has determined that said operation for forming a plurality of copy sets by making a plurality of copies of each of a plurality of originals is set, whether there is an original a preset number of copies of which have not been made;

a first control section for removing, when the second checking section has determined that there is an original a preset number of copies of which have not been made, copy sheets which are obtained by copying said original and are sorted onto the plural bins; and a second control section for restarting, after the first control section has removed the copy sheets of said original, the image forming operation from copying of said original in said predetermined order of the plural originals.

2. An image forming apparatus according to claim 1, wherein said first checking section is a CPU for controlling an entirety of the image forming apparatus.

3. An image forming apparatus according to claim 1, wherein said predetermined order in said operation for forming a plurality of copy sets by making a plurality of copies of each of a plurality of originals is an order of scanning the originals.

4. An image forming apparatus according to claim 1, wherein said predetermined order in said operation for forming a plurality of copy sets by making a plurality of copies of each of a plurality of originals is an order of data stored in a page memory.

5. An image forming apparatus according to claim 1, wherein said second checking section is a CPU for controlling an entirety of the image forming apparatus, said CPU confirming the number of images to be formed which is counted by a page memory control unit for controlling a page memory for temporarily storing image data of the originals.

6. An image forming apparatus according to claim 1, wherein said first control section performs a control to pick up only paper sheets which are sorted onto the plural bins and have images of said original and to discharge said paper sheets onto a recycle tray.

7. An image forming apparatus according to claim 1, wherein said second control section is a CPU for controlling an entirety of the image forming apparatus, said CPU restarting the image forming operation by reading out image data of said original from a page memory for temporarily storing image data of the originals.

8. An image forming method for forming images on paper sheets, using a sorter for sorting paper sheets with images onto a plurality of bins, the method comprising:

a first step of indicating occurrence of a jam and stopping an image forming operation of the image forming apparatus when the jam is detected during the image forming operation;

a second step of determining, when a process for dealing with the jam indicated in the first step is completed and a restart of the image forming operation is instructed, whether an operation for forming a plurality of copy sets by making a plurality of copies of each of a plurality of originals in a predetermined order is set;

a third step of determining, when the first step has determined that said operation for forming a plurality of copy sets by making a plurality of copies of each of a plurality of originals is set, whether there is an original a preset number of copies of which have not been made;

a fourth step of removing, when the third step has determined that there is an original a preset number of copies of which have not been made, copy sheets which are obtained by copying said original and are sorted onto the plural bins; and a fifth step of restarting, after the copy sheets of said original have been removed in the fourth step, the image forming operation from copying of said original in said predetermined order of the plural originals.

9. An image forming apparatus for forming images on paper sheets, which has a sorter for sorting paper sheets with images onto a plurality of bins, comprising:

means for setting an image forming operation that makes a number of copies of a document comprising a plurality of originals;

means for detecting an occurence of a malfunction of the apparatus during the image forming operation;

means for interrupting the image forming operation when said detecting means detects the occurrence of the malfunction;

means for designating a restart of the interrupted image forming operation after the apparatus recovered from the malfunction;

means, when the restart is designated by said designating means, for judging whether there is an original whose number of finished copies have not reached to the present number set by said setting means;

means for discharging the finished copies corresponding to the original from the bins of the sorter, when the judging means judges that the number of finished copies whose copying operation have not been finished; and means for storing the sheets discharged from the bins of the sorter.

10. An image forming apparatus for forming images on paper sheets, comprising:

an operation panel which sets an image forming operation that makes a number of copies of a document comprising a plurality of originals;

a sorter which sorts and stores finished copies onto a plurality of bins;

a pick-up roller which picks up the finished copies from the bins of the sorter;

a tray which stores the finished copies picked up by said pick-up roller; and a processing unit which performs a control which:

(a) detects an occurrence of a malfunction of the apparatus during the image forming operation, (b) interrupts the image forming operation, (c) judges whether there is an original whose number of finished copies have not reached to the preset number set by said operation panel, (d) restarts the interrupted image forming operation, and (e) picks up the finished copies corresponding to the original from the bin of the sorter with said pick-up roller, when it is judged that the number of finished copies whose copying have not been finished.

11. An image forming apparatus according to claim 10, further comprising:

a page memory which stores an image data of the original to be copied;

wherein said processing unit restarts the interrupted image forming operation by using the image data stored in said page memory at the beginning of the restarting.

12. An image forming method for forming images on paper sheets by using an image forming apparatus with a sorter, comprising:

detecting an occurrence of a malfunction of the image forming apparatus during an image forming operation;

interrupting the image forming operation when the occurrence of the malfunction is detected;

judging whether there is an original whose number of finished copies have not reached to a preset number to be copied;

discharging the finished copies to the sorter; and removing the finished copies corresponding to the original from the sorter, when the judging step judges that the number of finished copies whose copying operation have not been finished.

* * * * *